United States Patent [19]

Honeycutt

[11] 4,116,037

[45] Sep. 26, 1978

[54] TUBING SIZER AND STRAIGHTENER

[76] Inventor: Hugh A. Honeycutt, Rte. 1, Box 877, Los Lunas, N. Mex. 87031

[21] Appl. No.: 810,794

[22] Filed: Jun. 28, 1977

[51] Int. Cl.[2] ..... B21D 3/00

[52] U.S. Cl. ..... 72/409; 81/374; 140/147

[58] Field of Search ..... 72/409, 410, 407; 140/147; 81/374, 375, 376, 377, 378

[56] References Cited

U.S. PATENT DOCUMENTS

| | | | |
|---|---|---|---|
| 2,455,009 | 11/1948 | Hood | 30/251 |
| 2,556,725 | 6/1951 | Hurlbut | 72/409 |
| 2,740,435 | 4/1956 | Pritts | 72/386 |
| 2,814,222 | 11/1957 | Sanders | 72/409 |
| 3,357,460 | 12/1967 | Gawura | 72/409 |

FOREIGN PATENT DOCUMENTS

| | | | |
|---|---|---|---|
| 463,670 | 3/1950 | Canada | 81/376 |

*Primary Examiner*—C.W. Lanham
*Assistant Examiner*—Gene P. Crosby
*Attorney, Agent, or Firm*—Clarence A. O'Brien; Harvey B. Jacobson

[57] ABSTRACT

A tubing sizer and straightener having a first lever and a second lever connected to one another by a linkage which causes the levers to move to and from a position in which the levers are substantially parallel and adjacent to one another. Longitudinally extending jaw parts, one of which is mounted on one of the levers and the other of which is mounted on the linkage, thus move against one another along a common plane when the levers are substantially parallel and adjacent to one another for sizing and/or straightening a length of tubing disposed between the jaw parts.

7 Claims, 4 Drawing Figures

TUBING SIZER AND STRAIGHTENER

BACKGROUND OF THE INVENTION

1. Field of the Invention

This invention relates generally to a plier-like special purpose tool, and particularly to a compound leverage plier-like tool for sizing, or resizing, and straightening lengths of tubing, and the like.

2. Description of the Prior Art

Tubing is frequently discarded after use even though the tubing is capable of reuse, because the various bends in the tubing cause distortion of the cross section of the tubing as well as rendering the bent tubing fit only for certain purposes. If the tubing is to be reused, it must be restraightened and the cross section thereof restored to its proper form.

Prior U.S. patents believed pertinent to the above invention because they disclose various features of a similar nature are as follows:

U.S. Pat. No. 1,013,738, Burson, Jan. 2, 1912
U.S. Pat. No. 1,743,221, Koenig, Jan. 14, 1930
U.S. Pat. No. 2,301,079, Phipps, Nov. 3, 1942
U.S. Pat. No. 2,407,040, Jaramaschi, Sept. 3, 1946
U.S. Pat. No. 2,426,340, Bush, Aug. 26, 1947
U.S. Pat. No. 2,740,435, Pritts, Apr. 3, 1956
U.S. Pat. No. 2,761,339, Lazar-Willenhorst, Sept. 4, 1956
U.S. Pat. No. 2,920,661, Drukker, Jan. 12, 1960
U.S. Pat. No. 3,364,724, Schmidt, Jan. 23, 1968

SUMMARY OF THE INVENTION

It is an object of the present invention to provide a hand tool adaptable for straightening and restoring to its original size tubing, and the like, which has been distorted by excessive pressure, freezing, or bending.

It is another object of the present invention to provide a compound leverage plier-like tool of simple yet rugged and reliable construction.

It is a still further object of the present invention to provide a plier-like hand tool for straightening and resizing tubing, and the like, which is capable of engaging the tubing along a substantial length thereof while permitting pressure to be applied by manual gripping of the tool.

These and other objects are achieved according to the invention by providing a tubing sizing and straightening tool having: a first lever and a second lever; a first jaw part and a second jaw part; and a linkage pivotally connected to the first lever, the second lever, the first jaw part, and the second jaw part for sequentially moving the first jaw part and second jaw part toward and away from one another.

According to a preferred construction of the invention, each of the first lever and second lever includes a longitudinally extending member having longitudinally spaced ends, with the first lever having a cutout at one of the ends thereof for receiving the associated first jaw part. The latter advantageously comprises a longitudinally extending element provided with a semi-cylindrical groove, with the element being mounted on the longitudinally extending member of the first lever and arranged in the cutout thereof so as to extend longitudinally perpendicularly to the longitudinal extent of the member forming the first lever. The second jaw part, which is physically mounted on the linkage, is virtually identical to the first jaw part, and is disposed such that the groove of the first jaw part facing the groove of the second jaw part, and contrarily.

The linkage preferably includes a curved piece having spaced end portions joined by an intermediate portion, with one of the end portions being pivotally attached to the first lever. The intermediate portion is pivotally attached to a second lever at a point disposed between the point of pivotal attachment of the one of the end portions of the curved piece to the first lever, the location of the cutout in which the first jaw part is dipsosed on the first lever. The other of the end portions of the curved piece is provided with a cutout which receives the second jaw part. Advantageously, there is provided a pair of curved pieces of substantially identical construction and disposed in spaced, but parallel planes, for cooperating to support the second jaw part.

The linkage further includes a link pivotally connected to one of the ends of the longitudinally extending member forming the second lever at a point thereon adjacent the attachment of the curved piece to the second lever. The link is also pivotally connected to the first lever at a point adjacent to the cutout provided in the first lever and between the cutout and the point of attachment of the curved piece to the first lever. In this manner, the curved piece, or pieces, the link, and the longitudinally extending members forming the first and second levers cooperate to form a four-bar linkage arranged for bringing the jaw parts together in a common plane. That is, the faces of the jaw parts adjacent the grooves provided therein engage one another substantially simultaneously at all points thereof so as to abut on a common plane.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
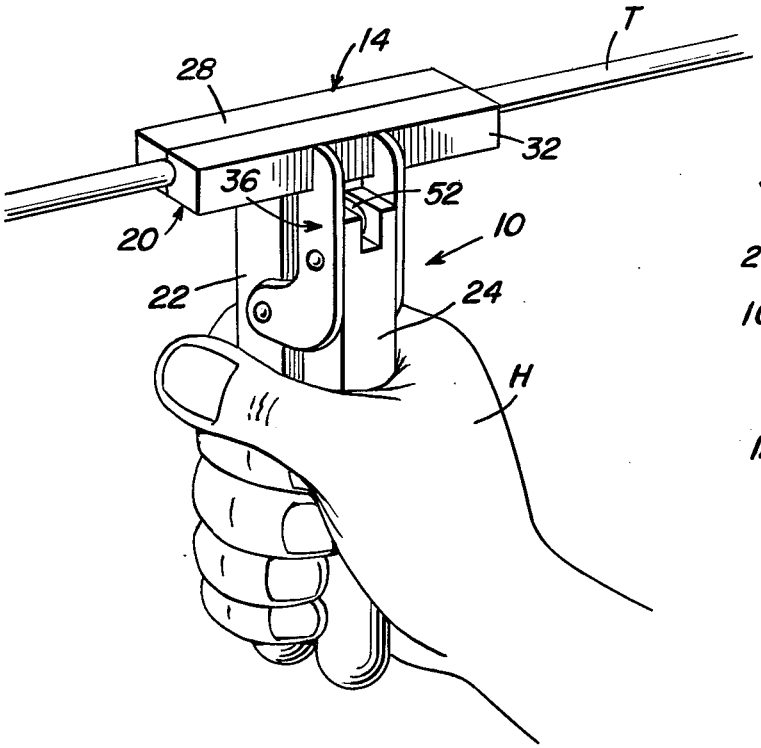
FIG. 1 is a partly schematic, perspective view showing a tubing sizer and straightener according to the present invention being used to straighten and resize a length of tubing.
Figure 4:
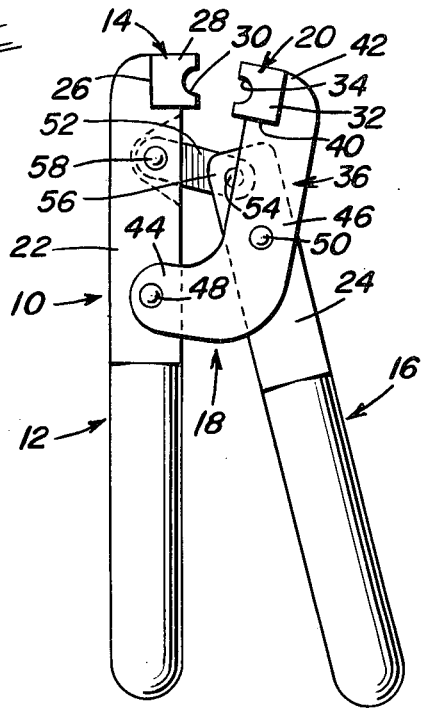
FIG. 4 is an end elevational view showing the tubing sizer and straightener of FIGS. 1-3 in a position wherein the jaw parts thereof are open for receiving a length of tubing therebetween.
Figure 2:
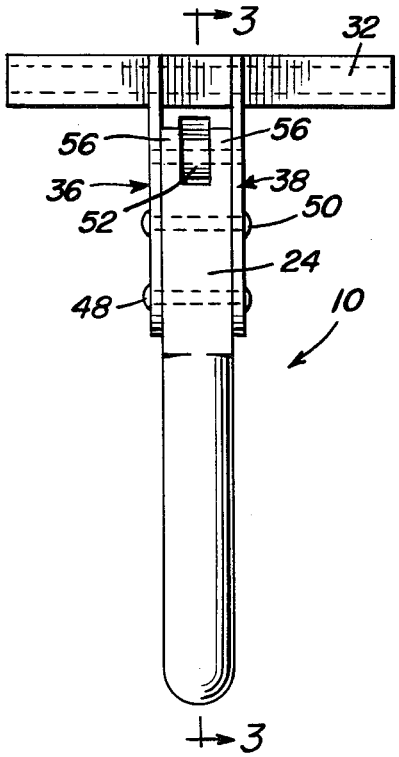
FIG. 2 is an enlarged, side elevational view showing the tool seen in FIG. 1.
Figure 3:
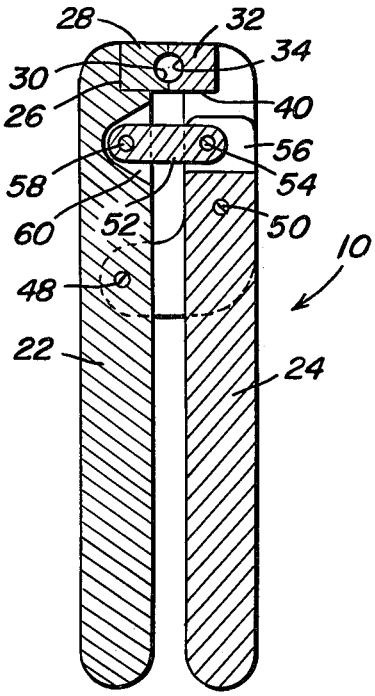
FIG. 3 is a sectional view taken generally along the line 3—3 of FIG. 2.

Referring now more particularly to the Figures of the drawing, a tubing sizer and straightener 10 according to the invention includes a first lever 12 on which is mounted a longitudinally extending jaw part 14. A second lever 16 is connected to lever 12 for movement to and from a position substantially parallel and adjacent to lever 12 by a linkage 18 on which is mounted a second jaw part 20. Linkage 18 is arranged for sequentially moving first jaw part 14 and second jaw part 20 toward and away from one another such that they will come into abutting relation along a common plane.

Each of the first lever 12 and second lever 16 includes longitudinally extending members 22 and 24, respectively, having longitudinally spaced ends. The member 22 forming first lever 12 has provided in one of the ends thereof a cutout 26 of substantially rectangular outline along the two sides defined for receiving the first jaw part 14. The latter is a longitudinally extending element 28 provided with a semi-cylindrical groove 30 extending the length thereof, and is mounted on member 22 in cutout 26 so as to extend longitudinally perpendicular to the longitudinal extent of member 22.

The second jaw part 20 is substantially identical in construction and configuration to first part 14, and is affixed to linkage 18 in a manner to be described below. More specifically, jaw part 20 includes a longitudinally extending element 32 of generally rectangular configuration and provided with a groove 34 extending longitudinally along one of the faces thereof. Groove 34 is disposed so as to face groove 30 and contrarily.

Linkage 18 includes at least one, and preferably the illustrated pair of curved pieces 36 and 38. Each of these curved pieces 36, 38 is provided with an identical cutout 40 in an end portion 42 thereof. Curved pieces 36, 38 have a pair of such end portions 42 and 44, joined by an intermediate portion 46. Suitable rivets 48 and 50 are used to attach together the curved pieces 36 and 38, and also to attach pieces 36 and 38 to the members 22 and 24 forming levers 12 and 16, respectively.

End portions 44 of curved pieces 36, 38 are pivotally attached to member 22 by rivet 48, while member 24 is pivotally attached to curved pieces 36, 38 by means of rivet 50. More specifically, end portion 44 is pivotally attached to lever 12 and intermediate portion 46 to lever 16, with the latter attachment being at a point between the point of pivotal attachment of end portion 44 to member 22 forming lever 12, and the first jaw part 14. The second jaw part 20 is disposed in the cutouts 40 provided at the end portions 42 of curved pieces 36, 38. Attachment of the jaw parts may be in a suitable manner, such as by welding, brazing, and the like.

Linkage 18 further includes a link 52 pivotally connected to one of the ends of the longitudinally extending member 24 at a point thereon adjacent the attachment of the curved pieces 36, 38 to second lever 16. This pivotal attachment is advantageously achieved as illustrated by use of a conventional pin 54 extending through a suitable aperture provided in link 52, adjacent one of the ends thereof, and through matching apertures provided in ears 56 formed in the uppermost end of member 24. That is, ears 56 are provided at the end of member 24 which is disposed adjacent jaw part 20. Link 52 is also pivotally connected to first lever 12 at a point thereon adjacent to cutout 26 and between cutout 26 and the point of attachment of curved pieces 36, 38 to member 22 forming lever 12. That is, the link 52 is pivotally connected to member 22 as by a conventional pin 68 passing through a recess 60 provided in member 22 at a point between cutout 26 provided at an end of member 22 and the point where rivet 48 pivotally attaches end portion 44 of curved pieces 36, 38 to member 22.

The provision of recess 60 permits link 52 to be pivotally mounted to lever 12 within the width of the member 22 forming the lever 12.

In operation, a length of tubing T to be repaired is placed in the grooves 30 and 34 of jaw parts 14 and 20 and the handle portions of levers 12 and 14 are squeezed together as by an operator's hand H. This squeezing compresses the tubing between the jaw parts 14 and 20, thereby restoring tubing T to its original diameter, while simultaneously straightening any bent portions of the tubing T. It is noted that by pressing the tubing T in sections of length equal to the length, or longitudinal extent, of the jaw parts 14 and 20, as much tubing T as desired may be straightened and resized.

As can be readily understood from the above description and from the drawing, a tubing sizer and straightener according to the invention permits tubing of various sizes and materials to be rapidly and easily restraightened and resized. Further, the diameter of tubing which may be straightened and resized can be varied by using jaw parts having grooves of corresponding sizes.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A tubing sizer and straightener, comprising, in combination:

(a) a first lever and a second lever:

(b) a first jaw part and a second jaw part; and (c) linkage means pivotally connected to the first lever, and the second lever for connecting the same to one another for sequentially moving the first jaw part and second jaw part toward and away from one another such that the first jaw part and second jaw part will abut one another along a common plane, each of the first lever and second lever including a longitudinally extending member having longitudinally spaced ends, the first lever having a cutout provided at one of the ends thereof, with the associated first jaw part comprising a longitudinally extending element provided with a semi-cylindrical groove, the element being mounted on the member forming the first lever and disposed in the cutout provided at an end of the member, with the element being disposed extending longitudinally perpendicularly to the longitudinal extent of the member forming the first lever, the second jaw part being substantially identical to the first jaw part, and being affixed to the linkage means and, with the second jaw part including a further groove disposed facing the groove of the first jaw part, the linkage means including a curved piece having spaced end portions joined by an intermediate portion, one of the end portions being pivotally attached to the first lever, and the intermediate portion being pivotally attached to the second lever at a point thereon disposed between the point of pivotal attachment of the one of the end portions to the first lever and the second jaw part, with a further cutout being provided on the curved piece in the other of the end portions, and the second jaw part being disposed at the other of the end portions of the curved piece and arranged received in the further cutout.

2. A structure as defined in claim 1, wherein the linkage means further includes a link pivotally connected to one of the ends of the longitudinally extending member forming the second lever at a point thereon adjacent the attachment of the curved piece to the second lever, and the link being pivotally connected to the first lever at a point on the member forming the first lever adjacent to the cutout provided in an end of the member forming the first lever and between the cutout and the point of attachment of the curved piece to the first lever, a curved piece, link, and members forming the first lever and second lever cooperating to form a four-bar linkage bringing the jaw parts together in a substantially parallel relation.

3. A structure as defined in claim 2, wherein there are a pair of spaced, substantially parallel curved pieces attached to the first lever and second lever on spaced sides of the members forming the first lever and second lever so as to have the first lever and second lever between the pair of curved pieces.

4. A tubing sizer and straightener, comprising, in combination:

(a) a first lever and a second lever;

(b) a first jaw part and a second jaw part; and (c) linkage means pivotally connected to the first lever, and the second lever for connecting the same to one another for sequentially moving the first jaw part and second jaw part toward and away from one another such that the first jaw part and second jaw part will abut one another along a common plane, the first lever having a cutout for receiving the first jaw part, and the linkage means including a curved piece having spaced end portions joined by an intermediate portion, one of the end portions being pivotally attached to the first lever, and the intermediate portion being pivotally attached to the second lever at a point thereon disposed between the point of pivotal attachment of the one of the end portions to the first lever and the second jaw part, with a further cutout being provided on the curved piece in the other end of the end portions, and the second jaw part being disposed at the other of the end portions of the curved piece and arranged received in the further cutout.

5. A structure as defined in claim 4, wherein there are a pair of spaced, substantially parallel curved pieces attached to the first lever and second lever on spaced sides of the members forming the first lever and second lever so as to have the first lever and second lever between the pair of curved pieces.

6. A structure as defined in claim 4, wherein the linkage means further includes a link pivotally connected to the second lever at a point thereon adjacent the attachment of the curved piece to the second lever, and the link being pivotally connected to the first lever at a point adjacent to the cutout provided in the first lever and between the cutout provided in the first lever and the point of attachment of the curved piece to the first lever, the curved piece, link, first lever, and second lever cooperating to form a four-bar linkage arranged for bringing the first jaw part and second jaw part together in substantially parallel relation.

7. A structure as defined in claim 6, wherein there are a pair of spaced, substantially parallel curved pieces attached to the first lever and second lever on spaced sides of the members forming the first lever and second lever so as to have the first lever and second lever between the pair of curved pieces.

* * * * *